US007396175B2

(12) United States Patent
Ueda

(10) Patent No.: US 7,396,175 B2
(45) Date of Patent: Jul. 8, 2008

(54) SHEET CARRIER AND IMAGE FORMING DEVICE

(75) Inventor: Kenji Ueda, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 89 days.

(21) Appl. No.: 10/829,962

(22) Filed: Apr. 23, 2004

(65) Prior Publication Data

US 2004/0265031 A1 Dec. 30, 2004

(30) Foreign Application Priority Data

Apr. 23, 2003 (JP) ..... 2003-117772

(51) Int. Cl.
*B41J 29/00* (2006.01)
*B41J 13/02* (2006.01)
*B65H 7/12* (2006.01)

(52) U.S. Cl. ..... 400/708; 400/636; 271/259; 271/260; 271/262; 271/266; 271/265.01

(58) Field of Classification Search ..... 400/708, 400/636; 271/122, 125, 259–260, 262, 266, 271/258.01, 265.01–265.04; 399/388
See application file for complete search history.

(56) References Cited

U.S. PATENT DOCUMENTS

| | | | | |
|---|---|---|---|---|
| 4,979,727 | A * | 12/1990 | Koike et al. | 271/3.03 |
| 5,896,192 | A * | 4/1999 | Nagase | 356/71 |
| 6,129,351 | A * | 10/2000 | Oohara et al. | 271/262 |
| 6,341,774 | B1 | 1/2002 | Ueda | 271/119 |
| 6,565,079 | B1 * | 5/2003 | Kakegawa et al. | 271/125 |
| 6,757,515 | B2 | 6/2004 | Ueda | 399/396 |
| 2003/0118384 | A1 * | 6/2003 | Moriyama | 399/382 |
| 2003/0118385 | A1 * | 6/2003 | Isemura et al. | 399/388 |
| 2003/0230845 | A1 * | 12/2003 | Fujii et al. | 271/176 |
| 2004/0188919 | A1 * | 9/2004 | Sakamaki et al. | 271/122 |
| 2004/0265031 | A1 | 12/2004 | Ueda | |

FOREIGN PATENT DOCUMENTS

| | | | |
|---|---|---|---|
| JP | 60023238 | * | 2/1985 |

(Continued)

OTHER PUBLICATIONS

U.S. Appl. No. 11/517,377, filed Sep. 8, 2006, Sagawa et al.

*Primary Examiner*—Daniel J. Colilla
*Assistant Examiner*—M. Ferguson-Samreth
(74) *Attorney, Agent, or Firm*—Oblon, Spivak, McClelland, Maier & Neustadt, P.C.

(57) ABSTRACT

A sheet carrier, includes an upstream side sheet carriage part; a downstream side sheet carriage part; an overlapping detection part which is provided between the upstream side sheet carriage part and the downstream side sheet carriage part and is configured to detect an overlap of a front sheet and a rear sheet carried by the upstream side sheet carriage part and the downstream side sheet carriage part; and a driving control part configured to drive the upstream side sheet carriage part and the downstream side sheet carriage part at the time when the sheets are carried so that the sheets are carried via the sheet carriage path, and configured to stop driving the upstream side sheet carriage part and continue driving the downstream side sheet carriage part at the time when the overlap of the sheets is detected by the overlapping detection part.

19 Claims, 15 Drawing Sheets

FOREIGN PATENT DOCUMENTS

| | | | |
|---|---|---|---|
| JP | 61-007174 | | 1/1986 |
| JP | 61051427 | * | 3/1986 |
| JP | 61060549 | * | 3/1986 |
| JP | 62130942 | * | 6/1987 |
| JP | 01303251 | * | 12/1989 |
| JP | 03227854 | * | 10/1991 |
| JP | 05246572 | * | 9/1993 |
| JP | 05-270699 | | 10/1993 |
| JP | 06-298405 | | 10/1994 |
| JP | 09-030684 | * | 4/1997 |
| JP | 09100048 | * | 4/1997 |
| JP | 09-142699 | | 6/1997 |
| JP | 10111964 | * | 4/1998 |
| JP | 10139216 | * | 5/1998 |
| JP | 11-59965 | | 3/1999 |
| JP | 11-301886 | | 11/1999 |
| JP | 2000-165594 | | 6/2000 |
| JP | 2002-326740 | | 11/2002 |
| JP | 2004107088 | * | 4/2004 |

* cited by examiner

SHEET CARRIER AND IMAGE FORMING DEVICE

BACKGROUND OF THE INVENTION

1. Field of the Invention

The present invention generally relates to an image forming device wherein an image is recorded to a sheet such as a paper or an OHP (Overhead Projector) film by using an electrophotographic method, for example, such as a copier, a printer, a facsimile device, or a complex machine consisting of the copier, the printer, and the facsimile. Furthermore, the present invention generally relates to a sheet carrier, by which the sheet is carried along a sheet carriage path, of a sheet usage device such as the above mentioned image forming device.

2. Description of the Related Art

Conventionally, an electrophotographic type image forming device having a sheet carrier described in Japanese Laid-Open Patent Application, No. 11-59965, is used. As shown in FIG. 1, for example, in this kind of sheet carrier, a sheet S sent from a sheet loading part 1 is carried to a drum-shaped photoconductor body 3 via a sheet carriage path 2. Then, a toner image formed on the photoconductor body 3 is transferred to the sheet S by a transcription roller 4, with the rotation of the photoconductor body 3.

In this sheet carrier, a first sheet carriage part 5, a second sheet carriage part 6, a third sheet carriage part 7, and a fourth sheet carriage part 8 are provided in sequence from the sheet loading part 1 to a downstream side along the sheet carriage path 2. Detection parts a, b, and c are provided at a just downstream positions from the first sheet carriage part 5, the second sheet carriage part 6, and the third sheet carriage part 7, respectively. A detection part d is provided at a just upstream position from the fourth sheet carriage part 8.

The first sheet carriage part 5 includes a pick up roller 5*a* forming a sheet feeding part, a feed roller 5*b* forming a separation part of FRR separation type, and a reverse roller 5*c*.

If a sheet feeding signal is on, the pick up roller 5*a* descends and rotates so that the sheets S loaded at the sheet loading part 1 are picked up by the pick up roller 5*a* from an upper side in sequence. Thee sheets S are separated and sent by the feed roller 5*b* and the reverse roller 5*c*. The sheet S is carried by a pair of the carriage rollers 6*a* and 6*b* of the second sheet carriage part 6 and a pair of carriage rollers 7*a* and 7*b* of the third sheet carriage part 7 via the sheet carriage path 2. A head end part of the sheet S is carried into resist rollers 8*a* and 8*b* of the fourth sheet carriage part 8 so as to be stopped and thereby a skew is corrected. After that, the resist rollers 8*a* and 8*b* are started rotating in timing with the toner image of the photoconductor body 3 so that the image position is adjusted and the sheet S is sent to a lower side of the photoconductor body 3.

When the head end of the carried sheet S is detected by the first detection part a, the rotation of the pick up roller 5*a* is stopped. When the head end of the carried sheet S is detected by the second detection part b, the rotations of the feed roller 5*b* and reverse roller 5*c* are stopped. When the head end of the carried sheet S is detected by the third detection part c, image writing to the photoconductor body 3 starts. The rotations of the carriage rollers 6*a*, 6*b*, 7*a* and 7*b* are stopped, after the head end is detected by the fourth detection part d and a designated time (time interval) passes.

Thus, the head end of the carried sheet S is detected so that the rotations of the pick up roller 5*a*, the feed back roller 5*b*, the reverse roller 5*c*, and the carriage rollers 6*a*, 6*b*, 7*a*, and 7*b* are stopped and the image writing starts. In addition, the head end part of the carried sheet S is carried into resist rollers 8*a* and 8*b* of the fourth sheet carriage part 8 so as to be stopped. Hence, when the image is recorded to the sheet S continuously, it is necessary to make a proper space between the sheets in front and behind.

However, due to increase in demand for providing image forming devices having high performance in order to be distinguishable from other companies' products, it is desired to increase the number of sheets where the image is recorded, per unit time. Thus, if a speed for recording the image is increased by making the performance of a motor high, it causes an increase of cost and noise, and reduces durability. If the space between the sheets in front and behind is made as small as possible, it is possible to increase the number of sheets where the image is recorded, per unit time, without making the performance of the motor high.

However, in the sheet carrier where such an FRR separation method is applied, the sheets S loaded at the sheet loading part 1 are picked up by the pick up roller 5*a* from the upper side in sequence. The sheets S are separated and sent by the feed roller 5*b* and the reverse roller 5*c*. Therefore, when the front sheet S is sent, the position of the head end of the rear sheet S is made non-uniform between the head end position p of the loaded sheet and the separation nip position q of the separation part.

Because of this, if the space between the sheets S in front and behind is made as small as possible, at the greatest, the front and rear sheets are carried under a state where the rear end of the front sheet S and the head end of the rear sheet S are overlapped by a length of space h between the head end position p of the loaded sheet and the separation nip position q of the separation part.

Carriage of the sheets S under a state where the front sheet and rear sheet are overlapped causes the following problems. First, it is difficult to detect the head end of the rear sheet S and therefore it is difficult to stop the rotations of the pick up roller 5*a*, the feed roller 5*b*, the reverse roller 5*c*, and the carriage rollers 6*a*, 6*b*, 7*a*, and 7*b*, and start the image recording. Secondly, it is difficult to stop the sheet S in a state where the head end part of the sheet S is carried into resist rollers 8*a* and 8*b* of the fourth sheet carriage part 8.

SUMMARY OF THE INVENTION

Accordingly, it is a general object of the present invention to provide a novel and useful in which one or more of the problems described above are eliminated.

Another and more specific object of the present invention is to provide a

The above object of the present invention is achieved by a sheet carrier, including:

an upstream side sheet carriage part provided at an upstream side of a sheet carriage path;

a downstream side sheet carriage part provided at a downstream side of the sheet carriage path;

an overlapping detection part which is provided between the upstream side sheet carriage part and the downstream side sheet carriage part and is configured to detect an overlap of a front sheet and a rear sheet carried by the upstream side sheet carriage part and the downstream side sheet carriage part; and a driving control part configured to drive the upstream side sheet carriage part and the downstream side sheet carriage part at the time when the sheets are carried so that the sheets are carried via the sheet carriage path, and configured to stop driving the upstream side sheet carriage part and continue driving the downstream side sheet carriage part at the time when the overlap of the sheets is detected by the overlapping detection part.

The above object of the present invention is also achieved by a sheet carrier, including:

an upstream side sheet carriage part provided at an upstream side of a sheet carriage path;

a downstream side sheet carriage part provided at a downstream side of the sheet carriage path;

overlapping detection means for detecting an overlap of a front sheet and a rear sheet carried by the upstream side sheet carriage part and the downstream side sheet carriage part, the overlapping detection means being provided between the upstream side sheet carriage part and the downstream side sheet carriage part; and driving control means for driving the upstream side sheet carriage part and the downstream side sheet carriage part at the time when the sheets are carried so that the sheets are carried via the sheet carriage path, and for stopping driving the upstream side sheet carriage part and continuing driving the downstream side sheet carriage part at the time when the overlap of the sheets is detected by the overlapping detection part.

According to the above mentioned inventions, when the overlap of the carried sheets is detected, the carriage of the front sheet continues while the carriage of the rear sheet is stopped, and therefore the problems of the overlap being generated by shortening the space between the front and rear carried sheets can be solved. As a result of this, it is possible to prevent generation of the problems due to the overlap.

The upstream side sheet carriage part may include a sheet feeding part configured to feed the sheets from a sheet loading part, and a separation part configured to separate and carry the sheets fed by the sheet feeding part, one by one.

According to the above mentioned invention, the problem of the overlap being generated by shortening the space between the front and rear carried sheets can be solved. As a result of this, it is possible to prevent generation of the problems due to the overlap. Furthermore, since the overlap problem can be solved, it is possible to increase the number of the carried sheets per unit time by shortening the space between the front sheet and the rear sheet.

A distance L2 between a nip position of the upstream side sheet carriage part and a detection position of the overlapping detection part may be longer than a distance L1 of a head end position of the sheets at the sheet loading part and a nip position of the separation part.

According to the above mentioned invention, even if the position of the head end of the rear sheet is made non-uniform between the sheet feeding part and the separation part so that the distance between the head end position of the sheets at the sheet loading part and the nip position of the separation part is made L1 as a maximum, when the overlap of the front sheet and rear sheet is detected by the overlap detecting part, a rear end of the front sheet is far from a nip position of the upstream side sheet carriage part. Hence, the front sheet is continued being carried smoothly by the downstream side sheet carriage part. Therefore, it is possible to solve the problem of the overlap of the front and rear sheets reliably.

The upstream side sheet carriage part and the downstream side sheet carriage part may be each formed by a pair of carriage rollers.

According to the above mentioned invention, in a general sheet carrier wherein a plurality of pairs of carriage rollers is used, problems due to the overlap generated by shortening the space between the front and rear carried sheets can be solved. As a result of this, it is possible to prevent generation of the problems due to the overlap.

The overlapping detection part may include: an emission part; and a light receiving part which is provided at an opposite side to the emission part in a state where the sheet carriage path is put between the emission part and the light receiving part and which is configured to receive light from the emission part.

According to the above mentioned invention, it is possible to detect the overlap of the sheets precisely at a low cost under a simple structure.

The overlapping detection part may include an emission part;

a reflection part which is provided at an opposite side to the emission part in a state where the sheet carriage path is put between the emission part and the reflection part and which is configured to reflect light from the emission part; and a light receiving part which is provided at the same side at the sheet carriage path as the emission part and which is configured to receive reflection light from the reflection part.

According to the above mentioned invention, it is possible to detect the overlap of the sheets precisely at a low cost under a simple structure.

The overlapping detection part may includes:

an emission part; and a light receiving part which is provided on the same side at the sheet carriage path as the emission part and which is configured to receive light reflected by the sheet passing through the sheet carriage path.

According to the above mentioned invention, it is possible to detect the overlap of the sheets precisely at a low cost under a simple structure.

The overlapping detection part may be configured to detect the overlap of the sheets and a sheet passing through the sheet carriage path.

According to the above mentioned invention, it is possible to detect the overlap of the sheets with the head end at a low cost under a simple structure.

The sheet carrier may further inculde:

a loaded sheet detection part configured to detect an amount of transmitted light of the sheets loaded at the sheet loading part;

wherein the overlap of the sheets and an amount of transmitted light of a single sheet passing are detected by the overlapping detection part, and a remaining amount of the sheets at the sheet loading part is detected by receiving an output signal of the loaded sheet detection part and the overlapping detection part.

According to the above mentioned invention, it is possible to detect the overlap of the sheets and the sheet remaining amount at a low cost under a simple structure.

The driving control part may determine that it is difficult to solve the overlap problem of the sheets, if the overlap is detected by the overlapping detection part before a designated time passes after the sheet passing is detected by the overlapping detection part.

According to the above mentioned invention, it is possible to classify cases of the overlap of the sheets into a solvable case and a difficult case to solve. In the case of the solvable case, the overlap problem can be solved so that it is possible to prevent generation of the problems due to the overlap. In the difficult case to solve, the case is determined as an overlap case so that the carriage of the sheets can be stopped and the situation can be noticed.

The designated time may be set as a time from a detection of a head end of the sheet passing by the overlapping detection part to arrival of the head end at the downstream side sheet carriage part.

According to the above mentioned invention, it is possible to detect the generation of the overlap precisely.

The driving control part may restart driving the upstream side sheet carriage part, after solution of the overlap problem is detected by the overlapping detection part and a designated time passes.

According to the above mentioned invention, it is possible to send the rear sheet in a proper timing after the overlap problem is solved, and therefore it is possible to properly keep the front and rear sheets having a designated space.

The above object of the present invention is solved by an image forming device having a sheet carrier, the sheet carrier including:

an upstream side sheet carriage part provided at an upstream side of a sheet carriage path;

a downstream side sheet carriage part provided at a downstream side of the sheet carriage path;

a overlapping detection part which is provided between the upstream side sheet carriage part and the downstream side sheet carriage part and is configured to detect an overlap of a front sheet and a rear sheet carried by the upstream side sheet carriage part and the downstream side sheet carriage part; and a driving control part configured to drive the upstream side sheet carriage part and the downstream side sheet carriage part at the time when the sheets are carried so that the sheets are carried via the sheet carriage path, and configured to stop driving the upstream side sheet carriage part and continue driving the downstream side sheet carriage part at the time when the overlap of the sheets is detected by the overlapping detection part.

According to the above mentioned invention, it is possible to provide an image forming device having the sheet carrier which achieves the above mentioned effect.

Other objects, features, and advantages of the present invention will become more apparent from the following detailed description when read in conjunction with the accompanying drawings.

DETAILED DESCRIPTION OF THE PREFERED EMBODIMENTS

A description will now be given, with reference to FIG. 2 through FIG. 17, of embodiments of the present invention.

Figure 1:
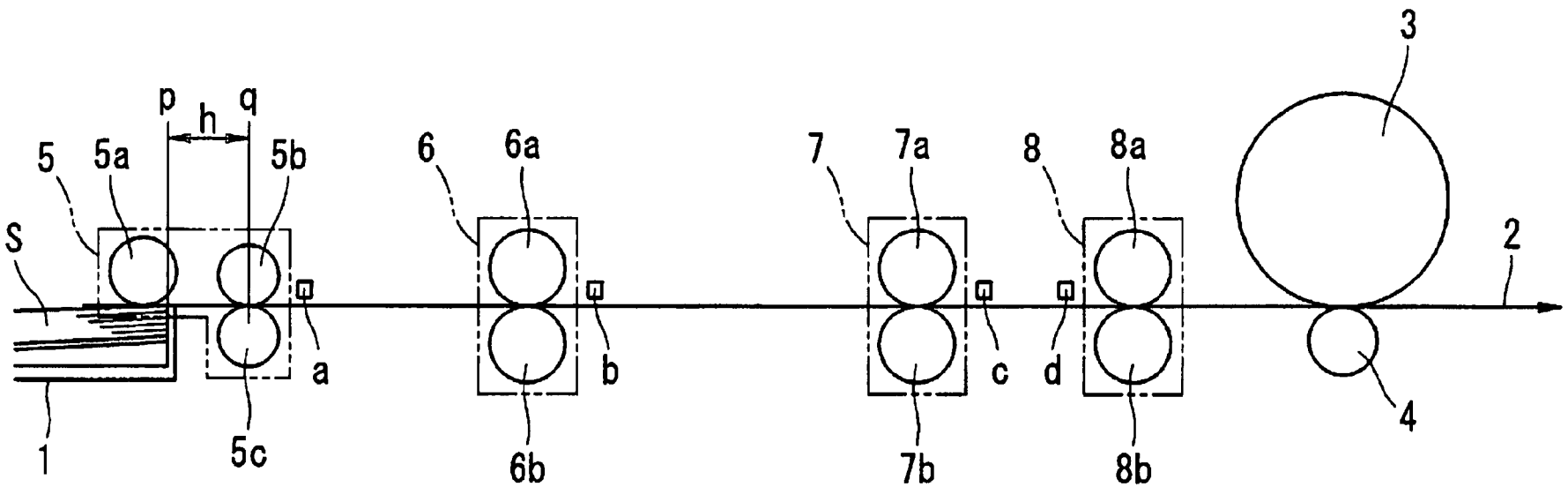
FIG.1 RELATED ART
FIG. 1 is a schematic structural view of a related art sheet carrier.
Figure 2:
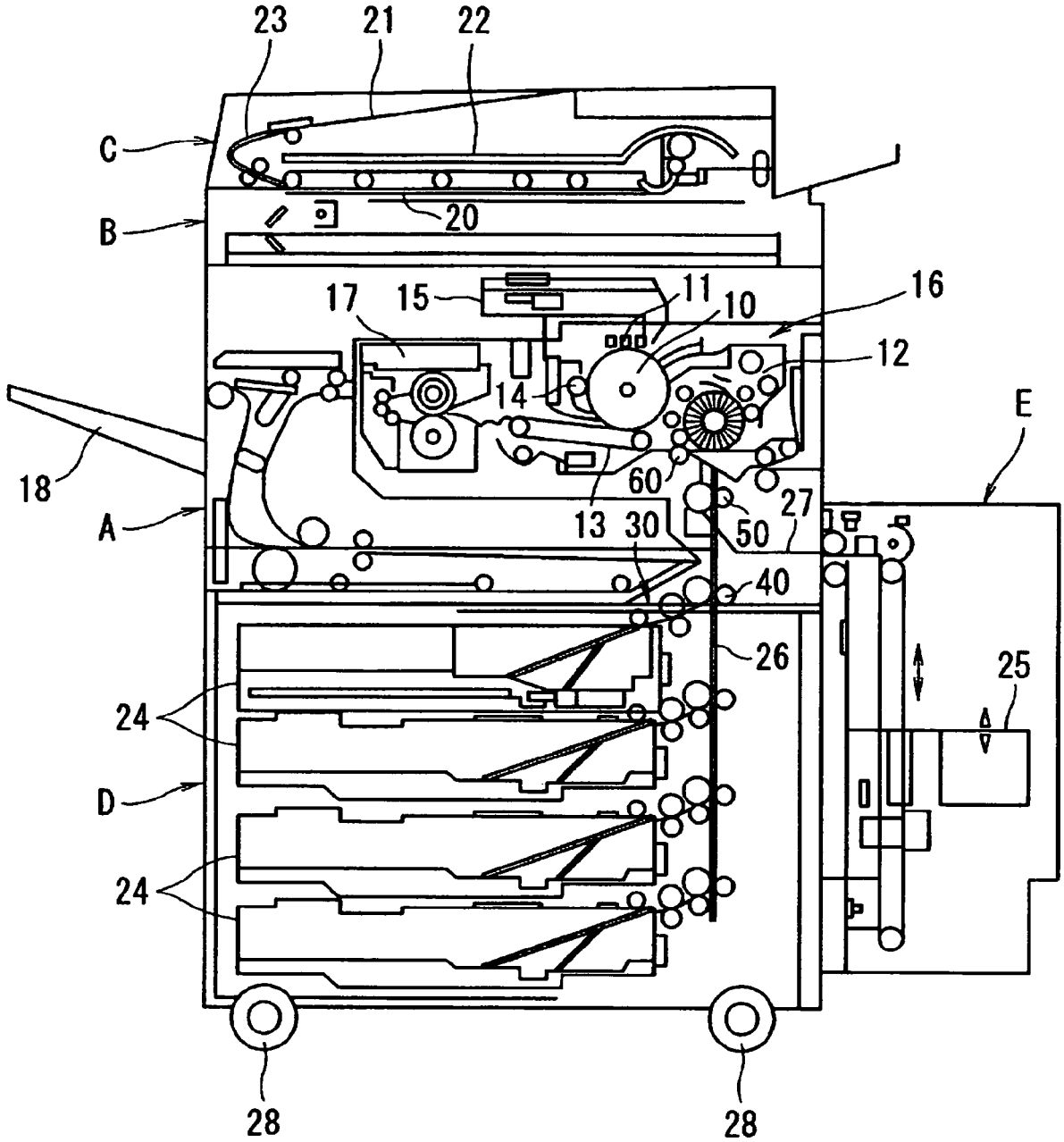
FIG. 2 is a schematic structural view of an electrophotographic type copier having a sheet carrier of the present invention.

FIG. 2 is a schematic structural view of an electrophotographic type copier having a sheet carrier of the present invention.

The copier shown in FIG. 2 has a copier main body A. A scanner B is provided on the copier main body A. On the scanner B, an ADF (Automatic Document Feeder) C is provided so as to be opened and closed. The copier main body A is provided on a sheet bank D. A supplier E of a large quantity of sheets is attached at the right side of the sheet bank D on which the copier main body A is provided.

An image forming part 16 is provided inside of the copier main body A. The image forming part 16 is formed by a drum-shaped photoconductor body 10 which functions as an image carrier, a charging device 11, a developing device 12, a transcription carriage device 13, a cleaning device 14, and a writing device 15. The charging device 11, the developing device 12, the transcription carriage device 13 and the cleaning device 14 are provided surrounding the photoconductor body 10. The writing device 15 is provided above the photoconductor body 10, the charging device 11, the developing device 12, the transcription carriage device 13 and the cleaning device 14. A fixing device 17 is lined up at a side of the image forming part 16. A discharging tray 18 is attached to the left side of the copier main body A.

A contact glass 20 is provided at an upper surface of the scanner B. A reading optical system is installed inside of the scanner B. A document put stand 21, a document discharge stand 22, and a sheet carriage path 23 are provided in the automatic document feeder C. The sheet carriage path 23 runs from the document put stand 21 to the document discharge stand 22 via the upper surface of the contact glass 20.

Multiple sheet storage cassettes 24 are stacked and each of them is provided detachably in the sheet bank D. Sheets such as papers or OHP (Overhead Projector) films are loaded in the respective sheet storage cassettes. In the supplier E of a large quantity of sheets, a large quantity of sheets are loaded and stored on a stand 25 for rising and descending.

A sheet carriage path 26 is formed from the respective sheet storage cassettes 24 of the sheet bank C to the image forming part 16 of the copier main body A. A sheet carriage path 27 is formed from the supplier E of a large quantity of sheets to the image forming part 16 of the copier main body A. Casters 28 are attached to the sheet bank D so that the copier can be moved to a proper position.

For making a copy of a document with this copier, first, the document is set on the document put stand 21 of the automatic document feeder C. Alternatively, the automatic document feeder C is opened and the document is directly set on the contact glass 20. Then, the automatic document feeder C is driven by pushing a start switch (not shown in FIG. 2). As a result of this, the document which is carried onto the contact glass 20 by the sheet carriage path 23 or the document which is set on the contact glass 20 in advance is read by the scanner B so as to be converted to digital image signals. After that, the document is discharged to the document discharge stand 22.

At the same time, a sheet S is picked up from one of the sheet storage cassettes 24 of the sheet bank D so as to be moved to the image forming part 16 via the sheet carriage path 26. Alternatively, the sheet S is picked up from the supplier E of a large quantity of sheets so as to be moved to the image forming part 16 via the sheet carriage path 27. The sheet S is sent to a lower part of the photoconductor body 10.

When the above described start switch is pushed, the photoconductor body 10 is rotated simultaneously and clockwise in FIG. 2. With the rotation of the photoconductor body 10, the cylindrical surface of the photoconductor body 10 is charged uniformly by the charging device 11. Then corresponding to contents read by the scanner, the contents are written with the writing device 15 by irradiating a writing light based on the digital image signals. An electrostatic latent image is formed on the cylindrical surface of the photoconductor body 10 and then toners is applied by the developing device 12. As a result of this, the electrostatic latent image is made a visible imagine.

Next, the visible image is tranferred to the sheet S which is sent to the lower part of the photoconductor body 10 by the transcription carriage device 13. The surface of the photoconductor body 10 in a state after the image is transferred is cleaned by removing the remaining toner with the cleaning device 14 so that the photoconductor body 10 is prepared for the next similar image forming.

The sheet S wherein the image is transferred is carried by the transcription carriage device 13 so as to move to the fixing device 17. In the fixing device 17, the transferred image is fixed by applying heat and pressure. After that, the sheet S is discharged onto the discharging tray 18.

Figure 3:
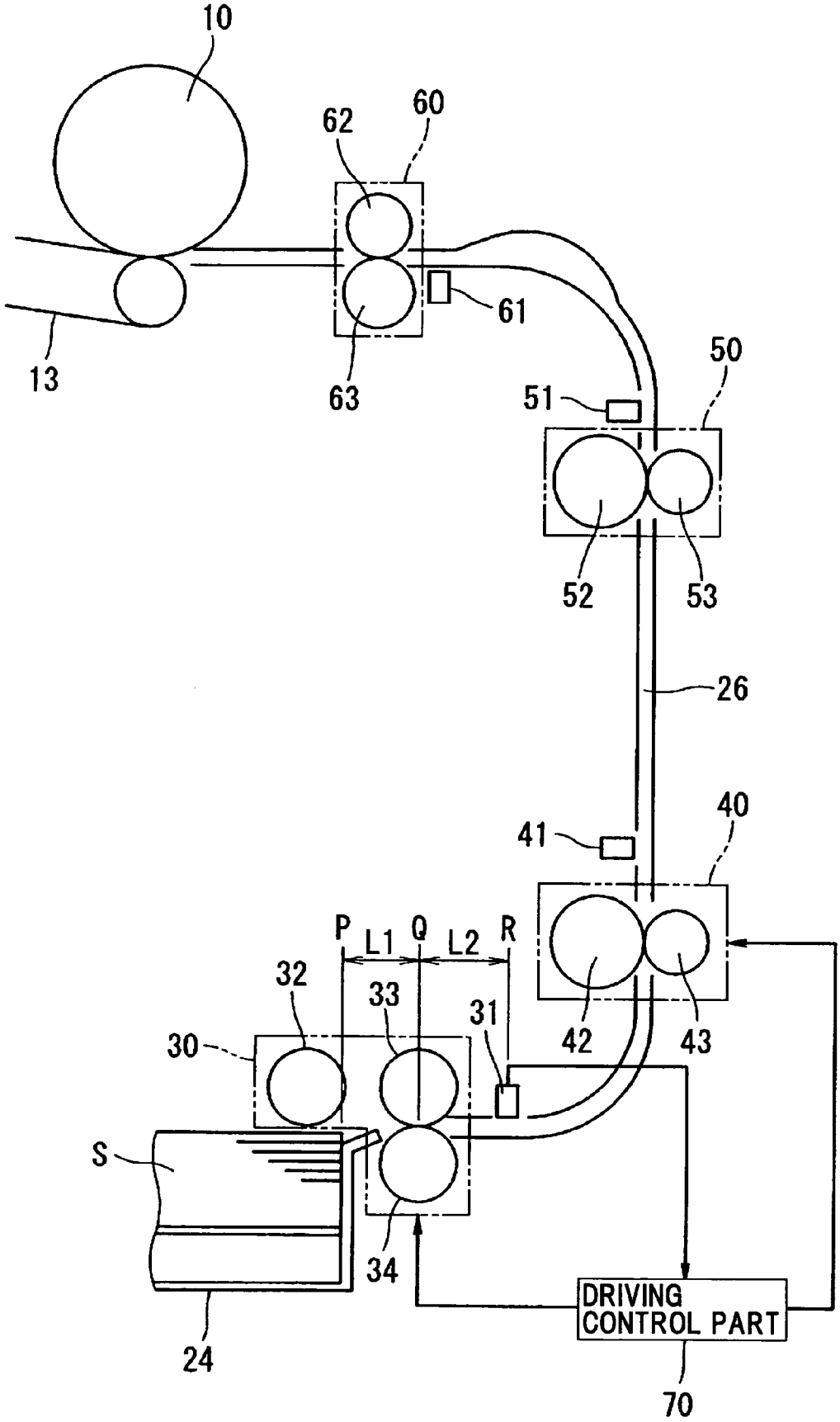
FIG. 3 is a structural view of a sheet carrier having a sheet carriage path leading from a sheet storage cassette situated at a highest step of a sheet bank to an image forming part of a copier main body.

The sheet carrier provided at the copier shown in FIG. 2 is shown in FIG. 3. More specifically, FIG. 3 shows the sheet carrier having the sheet carriage path 26 leading from the sheet storage cassette 24 situated at a highest step of the sheet bank D to the sheet carriage path 26 of the copier main body A.

As shown in FIG. 3, in this sheet carrier, a first sheet carriage part 30, a second sheet carriage part 40, a third sheet carriage part 50, and a fourth sheet carriage part 60 are provided in sequence from the sheet storage cassette 24 situated at the highest step of the sheet bank D to a downstream side along the sheet carriage path 26. Sensors 31, 41 and 51 are provided at just downstream positions of the first sheet carriage part 30, the second sheet carriage part 40, and the third sheet carriage part 50, respectively, as detection parts. A sensor 61 is provided at a just upstream position of the fourth sheet carriage part 60 as a detection part.

The first sheet carriage part 30 includes a sheet feeding part and a separation part. The sheet feeding part sends the sheets S from the sheet storage cassette 24 forming a sheet loading part. The separation part separates and carries each of the sheets sent by the sheet feeding part. A pick up roller 32 is provided as the sheet feeding part. A FRR separation type is used for the separation part and a feed roller 33 and a reverse roller 34 are provided as the separation part.

The second sheet carriage part 40 is formed by a pair of carriage rollers 42 and 43. The third sheet carriage part 50 is formed by a pair of carriage rollers 52 and 53. The fourth sheet carriage part 60 is formed by a pair of resist rollers 62 and 63.

The sheet feeding part and the separation part of the first sheet carriage part 30 are driving-controlled by a driving control part 70 so as to be rotationally driven by the same driving source (not shown). The second sheet carriage part 40 is driving-controlled by the driving control part 70. An output signal of the first sensor 31 is input to the driving control part 70.

At the time of starting feeding the sheets S from the sheet storage cassette 24, the pick up roller 32 descends and rotates so that the sheets S loaded in the sheet storage cassette 24 are picked up by the pick up roller 32 in sequence. The sheets S are separated and sent one by one by the feed roller 33 and the reverse roller 34.

Figure 4:
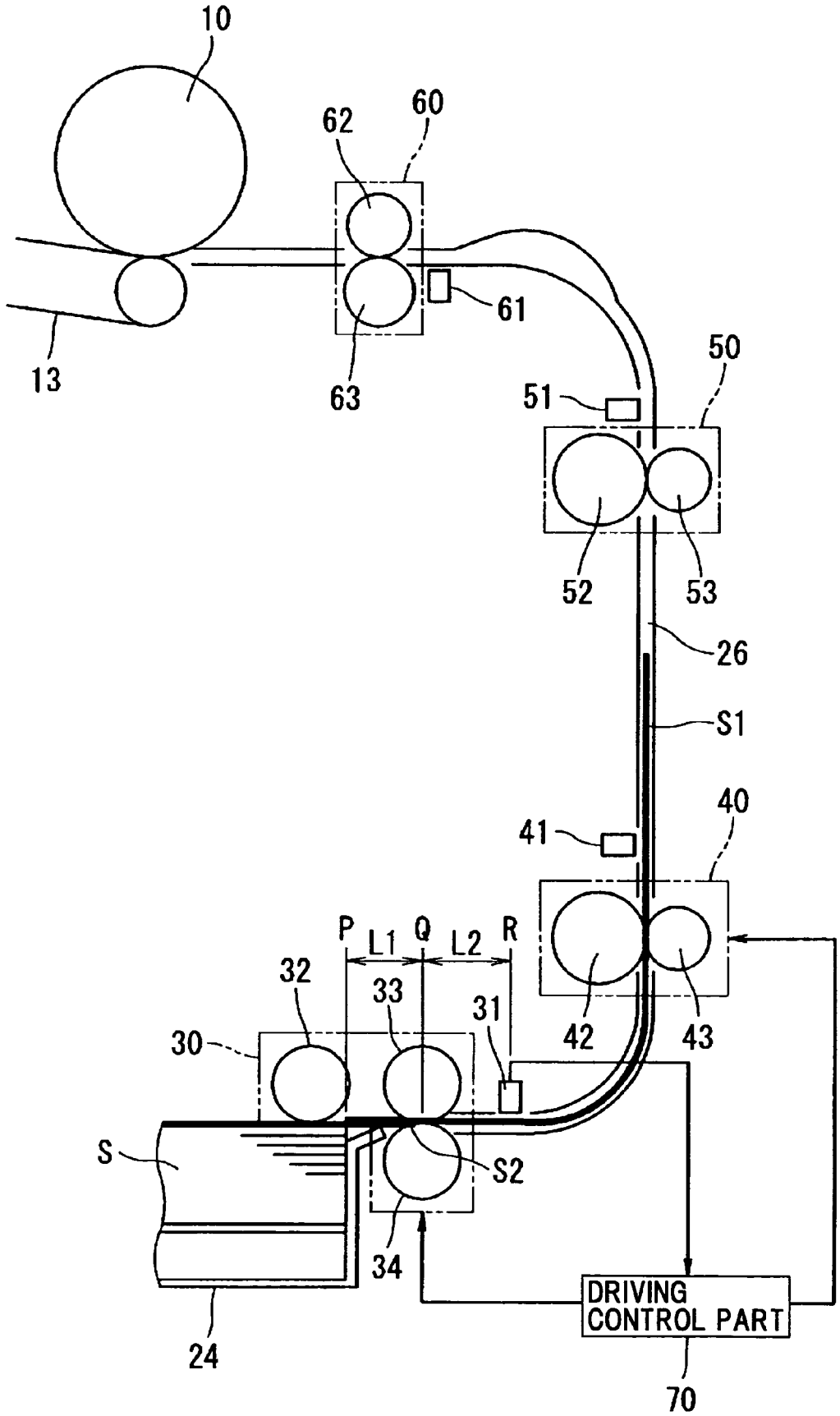
FIG. 4 is a view showing a state where a sheet sent by a feed roller and a reverse roller is carried by a pair of carriage rollers of a second sheet carriage part.

FIG. 4 is a view showing a state where a sheet S, sent by the feed roller 33 and the reverse roller 34 via the sheet carriage path 26, is carried by the pair of carriage rollers 42 and 43 of the second sheet carriage part 40.

The sheet S having passed through the pair of the carriage rollers 42 and 43 of the second sheet carriage part 40 is further carried via the sheet carriage path 26. The sheet S is further carried by the pair of the carriage rollers 52 and 53. A head end part of the sheet S is carried into the resist rollers 62 and 63 of the fourth sheet carriage part 60 so as to be stopped and thereby a skew is corrected. After that, the resist rollers 62 and 63 are started rotating in timing with the toner image of the photoconductor body 10 so that the image position is adjusted and the sheet S is sent to a lower side of the photoconductor body 10.

While the sheet S is being carried, when the head end of the carried sheet S is detected by the first sensor 31, the pick up roller 32 is raised and stopped being rotated. When the head end of the carried sheet S is detected by the second sensor 41, the rotations of the feed roller 33 and reverse roller 34 are stopped. When the head end of the carried sheet S is detected by the third sensor 51, an image is started being written to the photoconductor body 10. The rotations of the carriage rollers 42, 43, 52 and 53 are stopped, after the head end is detected by the fourth detector 61 and a designated time (time interval) passes.

Figure 5:
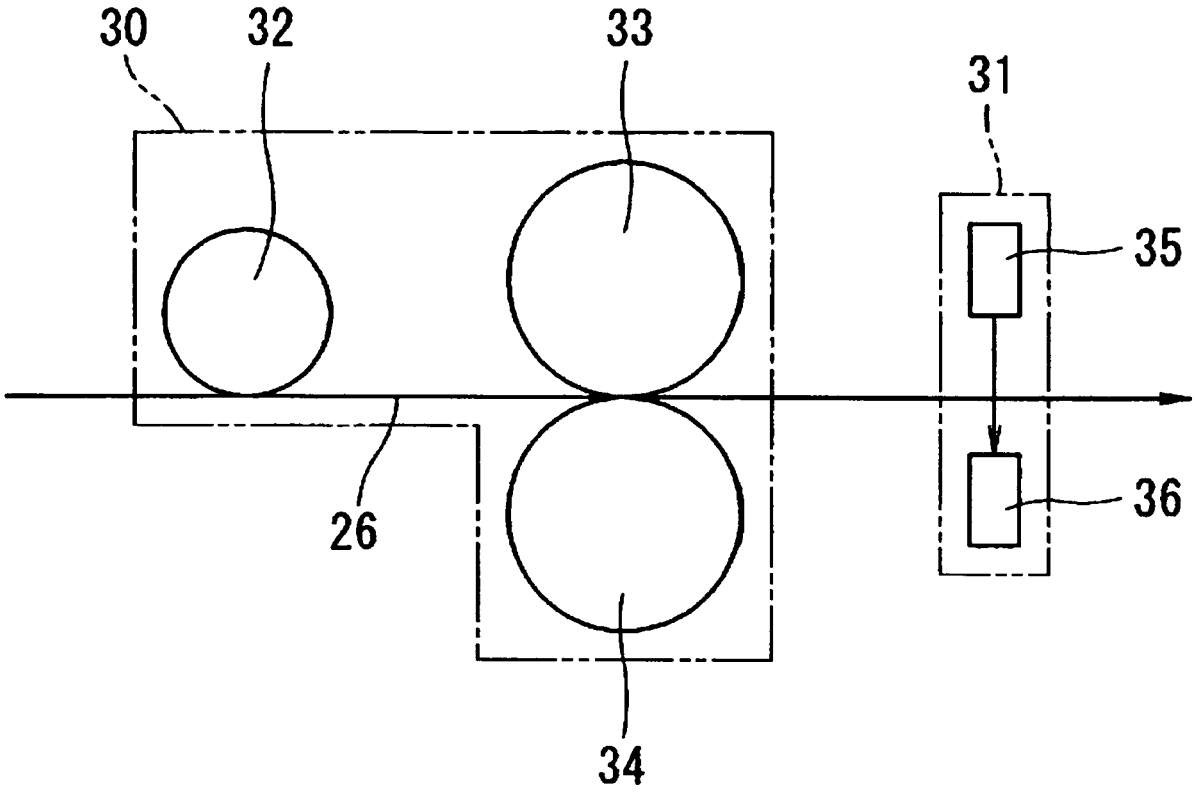
FIG. 5 is a structural view of a first sensor provided between a first sheet carriage part and the second sheet carriage part.

Meanwhile, FIG. 5 is a structural view of the first sensor 31 provided between the first sheet carriage part 30 and the second sheet carriage part 40.

As shown in FIG. 5, the first sensor 31 includes an emission part 35 and a light receiving part 36. A light emitting device such as a light emitting diode is used as the emission part 35. A light receiving device such as a photo diode is used as the light receiving part 36. The light receiving part 36 is provided at an opposite side to the emission part 35 in a state where the sheet carriage path 26 is put between the emission part 35 and the light receiving part 36. The light receiving part 36 receives light from the emission part 35 so that an amount of the light is converted to a voltage and output.

Figure 6:
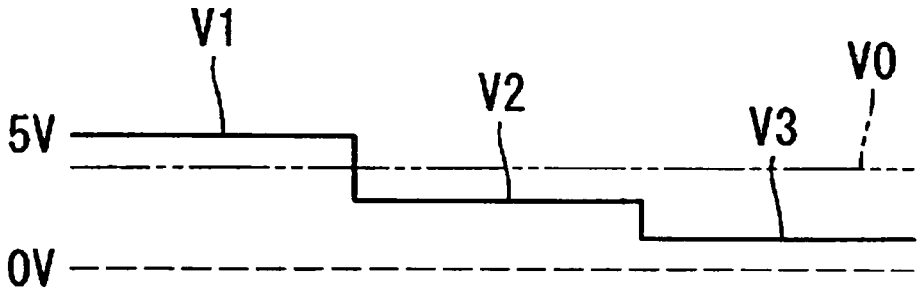
FIG. 6 is a graph showing a relationship between a sheet passing a first sensor position and an output of a light receiving part of a first sensor.

FIG. 6 is a graph showing a relationship between a sheet S passing the first sensor position and an output of the light receiving part 36 of the first sensor 31.

For example, as shown in FIG. 6, if the sheet S is not situated at the first sensor 31 position of the sheet carriage path 26, the transmittance rate is 100% so that an output voltage V1 of the light receiving part 36 is 5 V. If a single sheet S is situated at the first sensor 31 position of the sheet carriage path 26, the transmittance rate is reduced so that the output voltage is reduced to V2. If two sheets S are situated at the first sensor 31 position of the sheet carriage path 26, the transmittance rate is further reduced so that the output voltage is reduced to V3.

Thus, since the output voltage of the light receiving part 36 is reduced to a value less than constant value V0 which is less than 5 V, it is possible to detect an overlap of a front sheet S1 and a rear sheet S2 carried by the first sheet carriage part 30 and the second sheet carriage part 40, by the first sensor 31. It is also possible to detect the sheet S passing the first sensor 31 position of the sheet carriage path 26.

Meanwhile, in the above discussed FRR separation type sheet carrier, the sheets S loaded in the sheet storing cassette 24 are picked up by the pick up roller 32 from the upper side in sequence. Each of the sheets S are separated and sent by the feed roller 33 and the reverse roller 34. Hence, as shown in FIG. 4, when the front sheet S1 is sent, the rear sheet S2 situated under the first sheet S1 may overlap and be sent due to friction. Therefore, the position of the head end of the rear sheet S2 may be made non-uniform between the head end position P of the loaded sheet S and the separation nip position Q of the separation part.

Accordingly, if the space between the front sheet S1 and the rear sheet S2 is made as small as possible so as to be close to 0 (zero) and the rear sheet S2 is started being picked up by the pick up roller 32 at the same time that the rear end of the front sheet S1 comes out of the head end position P of the loaded sheets S, when the head end of the rear sheet S2 is situated close to the separation nip position Q, the front sheet S1, the rear sheet S2, and a sheet situated under the rear sheet S2 may simultaneously enter into the separation nip part between the feed roller 33 and the reverse roller 34. In this case, the separation ability of the FRR separation method is not brought into full play. Hence, in this case, the front sheet S1 and rear sheet S2 may be carried, while the rear end of the front sheet S1 and the front end of the rear sheet S2 may be overlapped and the overlap may be L1, which is the space between the head end position P of the loaded sheet and the separation nip position P of the separation part, as a maximum.

Figure 7:
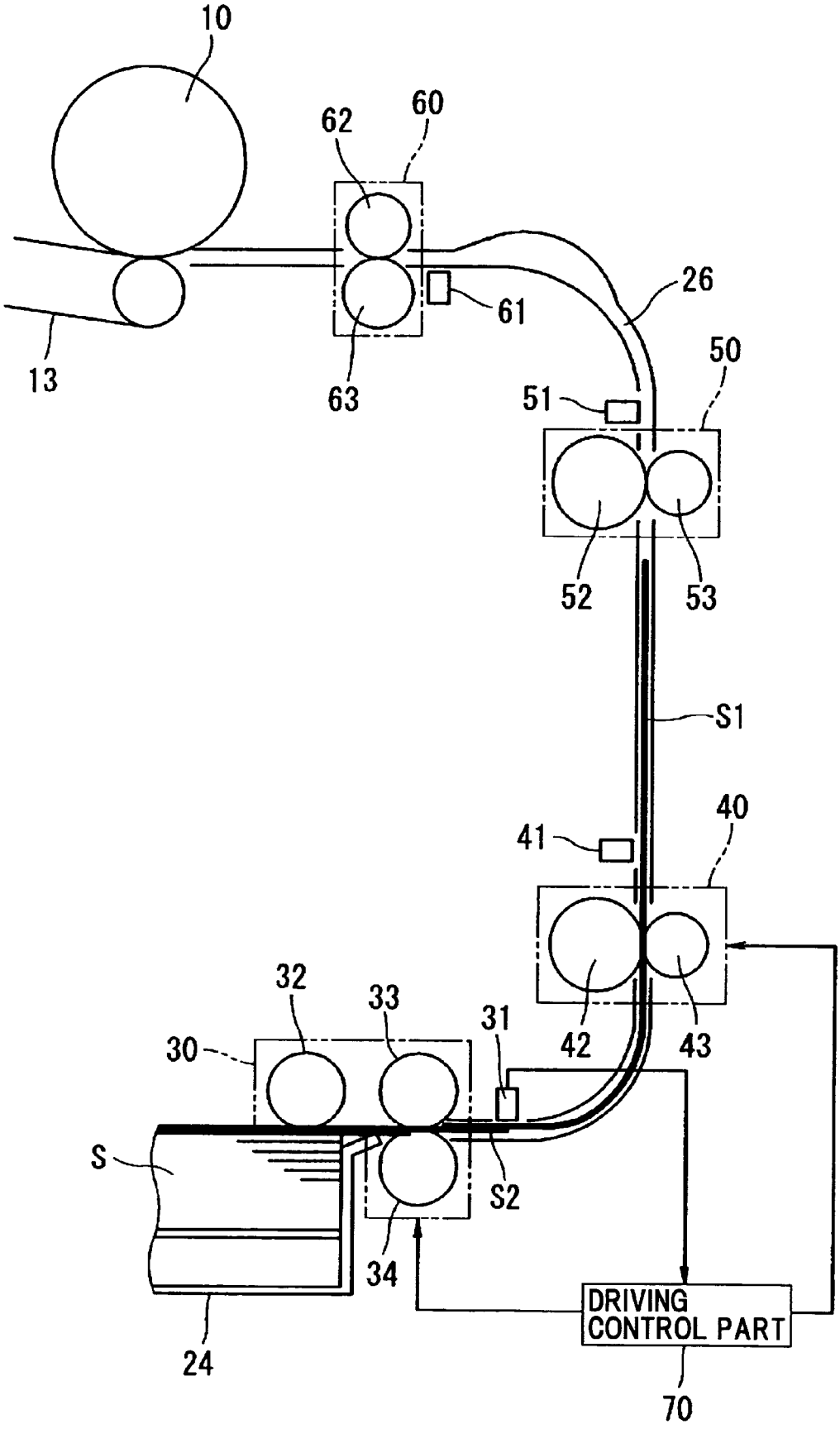
FIG. 7 is a view showing a state where sheets having overlap are carried and the overlap is detected by the first sensor which is a overlapping detection part.

FIG. 7 is a view showing a state where sheets having overlap are carried and the overlap is detected by the first sensor 31, which is an overlapping detection part.

The driving control part 70 carries the sheet S via the sheet carriage path 26 by driving the first sheet carriage part 30 and the second sheet carriage part 40 when the sheet is carried. In addition, the driving part 70 stops driving the first carriage part 30 and keeps driving the second sheet carriage part 40 when the overlap is detected by the first sensor 31.

Figure 8:
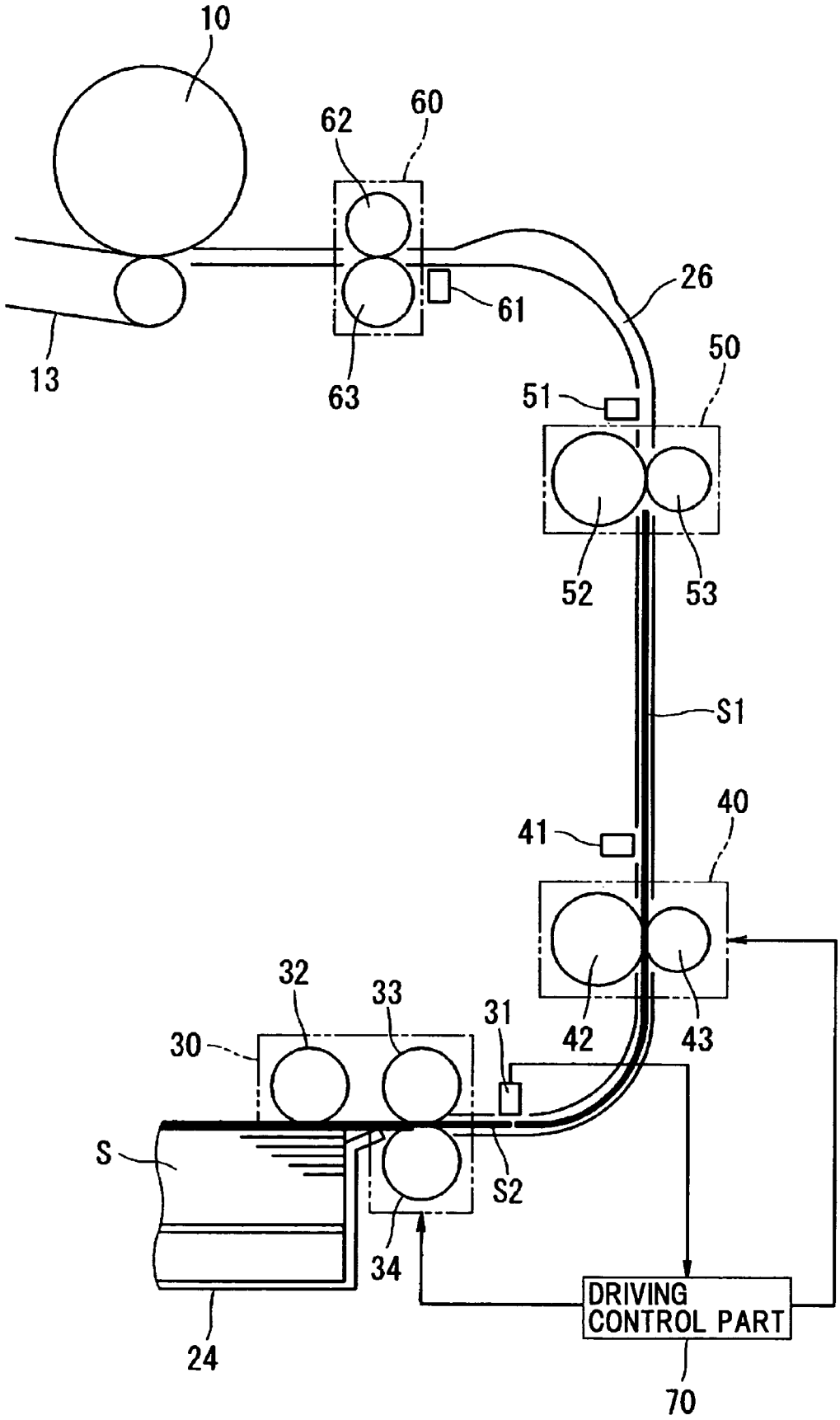
FIG. 8 is a view showing a state where the overlap problem of the sheets is solved.
Figure 9:
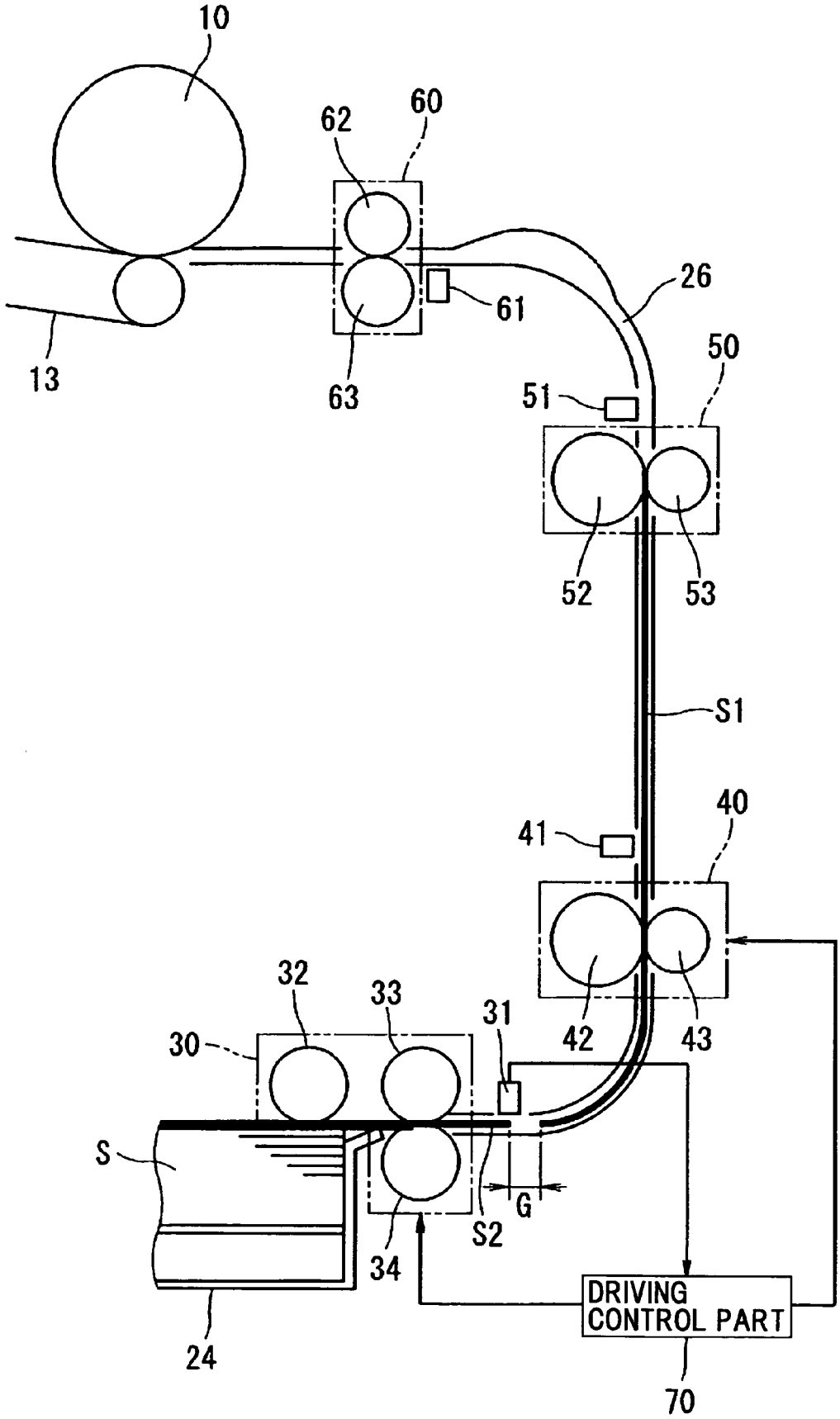
FIG. 9 is a view showing a state where a front sheet and a rear sheet are carried with a designated distance after the overlap of the sheets is solved.
Figure 10:
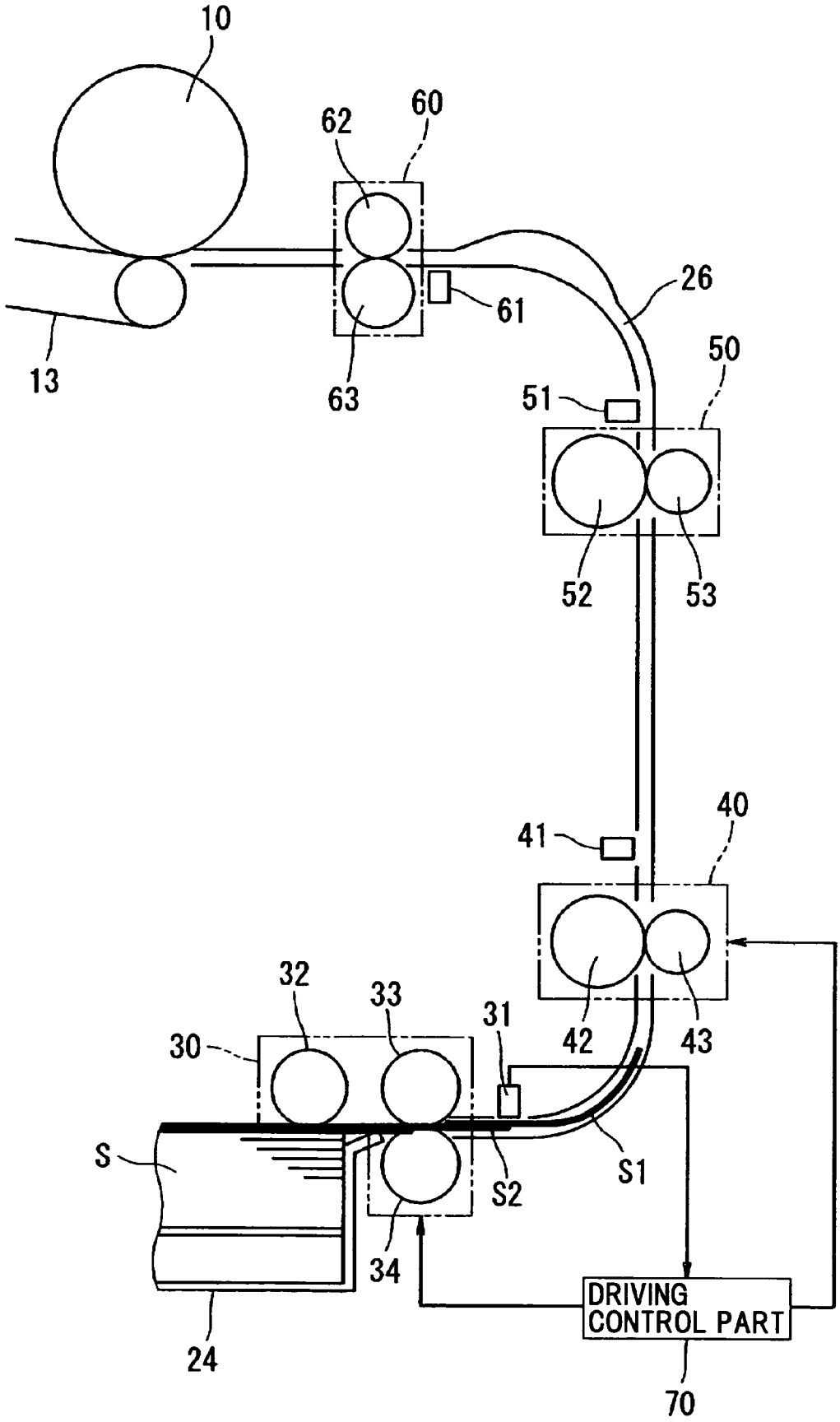
FIG. 10 is a view showing a state where the overlap of the sheets is detected.

As a result of this, while the rear sheet S2 is stopped, only the front sheet S1 is carried so that the overlap problem is solved as shown in FIG. 8. After the solution of the overlap problem is detected by the first sensor 31 and a designated time passes, the driving control part 70 restarts driving of the first sheet carriage part 30. In addition, the rear sheet S2 is started being carried again and therefore both sheets S1 and S2 are carried with a designated space G in between as shown in FIG. 9.

It is preferable, as show in FIG. 3, that a distance L2 between the nip position Q of the separation part of the first sheet carriage part 30 and a detection position R of the first sensor (overlapping detection part) 31 be longer than a distance L1 of the head end position P of the sheets loaded in the sheet storing cassette 24 and the separation nip position Q of the separation part.

Because of the above-discussed structure, even if the position of the head end of the rear sheet S2 is made non-uniform between the sheet feeding part and the separation part so that the distance between the head end position of the sheets at the sheet loading part and the nip position of the separation part is made L1 as a maximum, as show in FIG. 7, when the overlap of the front sheet S1 and rear sheet S2 is detected by the first sensor 31, the rear end of the front sheet is far from the separation part. Hence, the front sheet S1 is continued to be carried smoothly by the second sheet carriage part 40. Therefore, it is possible to solve the overlap problem of the front sheet S1 and rear sheet S2 reliably.

Meanwhile, when the sheets are supplied, the sheets S sent from the sheet supply cassette 24 may not be separated by the separation part and therefore plural sheets S that are completely overlapped or non-uniformed a little may enter between the feed roller 33 and the reverse roller 34. In this case, as shown in FIG. 9, the overlap is detected by the first sensor 31 before the head end of the front sheet S1 arrives at a space between the carriage rollers 42 and 43 of the second sheet carriage part 40.

In this case, since the head end of the front sheet S1 does not reach the space between the carriage rollers 42 and 43, even if the second sheet carriage part 40 is continued to be driven, in a case where the first sheet carriage part 30 is stopped being driven, the front sheet S1 cannot be carried. Hence, if the overlap of the sheets S is detected by the first sensor 31 after the passing sheet S is detected by the first sensor 31 but before a constant time T passes, the driving control part 70 automatically determines that it is difficult to solve the overlap problem.

Because of this structure, it is possible to classify cases of the overlap of the sheets S into a solvable case and a difficult case to solve. In the case of the solvable case, the overlap problem can be solved so that it is possible to prevent generation of the problems due to the overlap. In the difficult case to solve, the case is determined as an overlap case so that the carriage of the sheet can be stopped and the situation can be noticed.

It is possible to detect the generation of the overlap reliably by setting a time (time interval) from after the head end of the sheet S passing is detected by the first sensor 31 to before the head end of the sheet S passing arrives at the second sheet carriage part 40 as the above mentioned constant time T, for example.

In the above-discussed example, as shown in FIG. 5, the first sensor 31 includes the emission part 35 and the light receiving part 36. The light receiving part 36 is provided at an opposite side to the emission part 35 in a state where the sheet carriage path 26 is put between the emission part 35 and the light receiving part 36. The light receiving part 36 receives light from the emission part 35.

Figure 11:
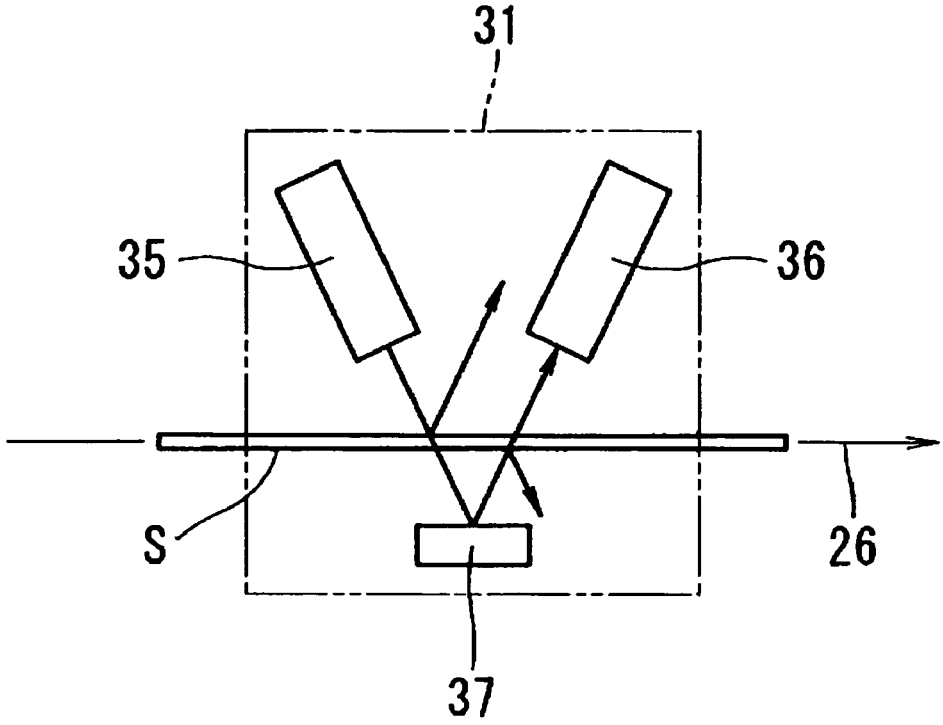
FIG. 11 is a structural view of another example of the first sensor which is the overlapping detection part.

However, the present invention is not limited to this. As shown in FIG. 11, the first sensor 31 may include the emission part 35, a reflection part 37 and a light receiving part 36.

In this case, the reflection part 37 is provided at an opposite side to the emission part 35 in a state where the sheet carriage path 26 is put between the emission part 35 and the reflection part 37. The reflection part 37 reflects light from the emission part 35. The light receiving part 36 is provided at the same side at the sheet carriage path 26 as the emission part 35. The light receiving part 36 receives reflection light from the reflection part 37.

For example, as shown in FIG. 6, if the sheet S is not situated at the first sensor position 31 of the sheet carriage path 26, although a partial loss is generated due to reflection by the reflection part 37, the transmittance rate is 100% so that an output voltage V1 of the light receiving part 36 is 5 V. If a single sheet S is situated at the first sensor position 31 of the sheet carriage path 26, the transmittance rate is reduced so that an output voltage is reduced to V2. If two sheets S are situated at the first sensor position 31 of the sheet carriage path 26, the transmittance rate is further reduced so that an output voltage is reduced to V3. Although a part of the light from the emission part 35 is reflected by a surface of the sheet S, the light receiving part 36 is provided so as to not receive the reflection light.

Figure 12:
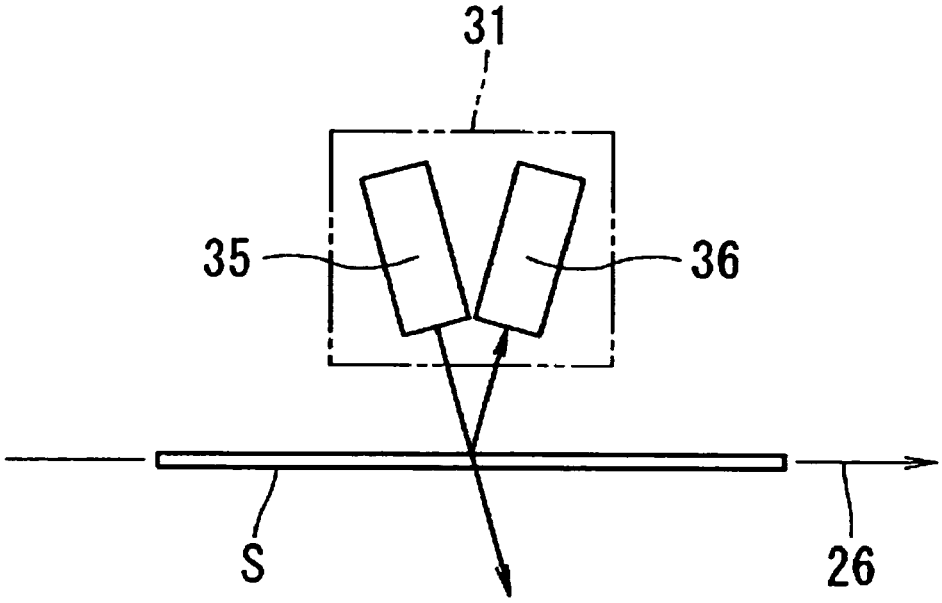
FIG. 12 is a structural view of other example of the first sensor which is the overlapping detection part.

Furthermore, as shown in FIG. 12, the first sensor 31 may include the emission part 35 and a light receiving part 36 which is provided on the same side of the sheet carriage path 26 as the emission part 35. The light receiving part 36 receives light reflected by the sheet S passing through the sheet carriage path 26.

Figure 13:
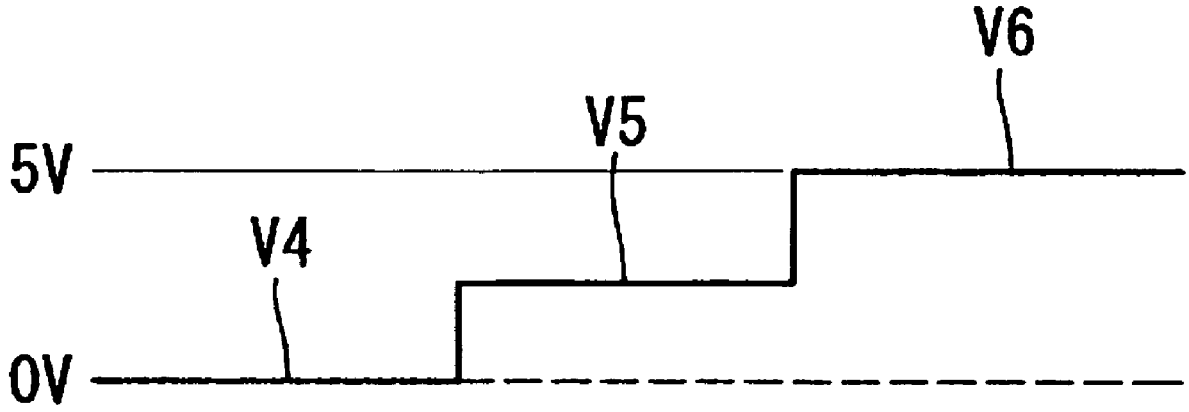
FIG. 13 is a view showing a relationship between the sheets passing.

For example, as shown in FIG. 13, if the sheet S is not situated at the first sensor position 31 of the sheet carriage path 26, the reflection rate is 0% so that an output voltage V4 is the emission part 36 is 0 V. If a single sheet S is situated at the first sensor position 31 of the sheet carriage path 26, a part of the light from the emission part 35 is reflected by the sheet S so that the output voltage is increased to V5. If two or more sheets S are situated at the first sensor position 31 of the sheet carriage path 26, transmitting light is further reduces so that the output voltage V6 increases to approximately 5 V.

In any case, it is possible to detect not only the overlap of the front and rear sheets S carried by the first sheet carriage part 30 and the second sheet carriage part 40 but also the sheet S passing the first sensor position 31 of the sheet carriage path 26, by the first sensor 31.

Figure 14:
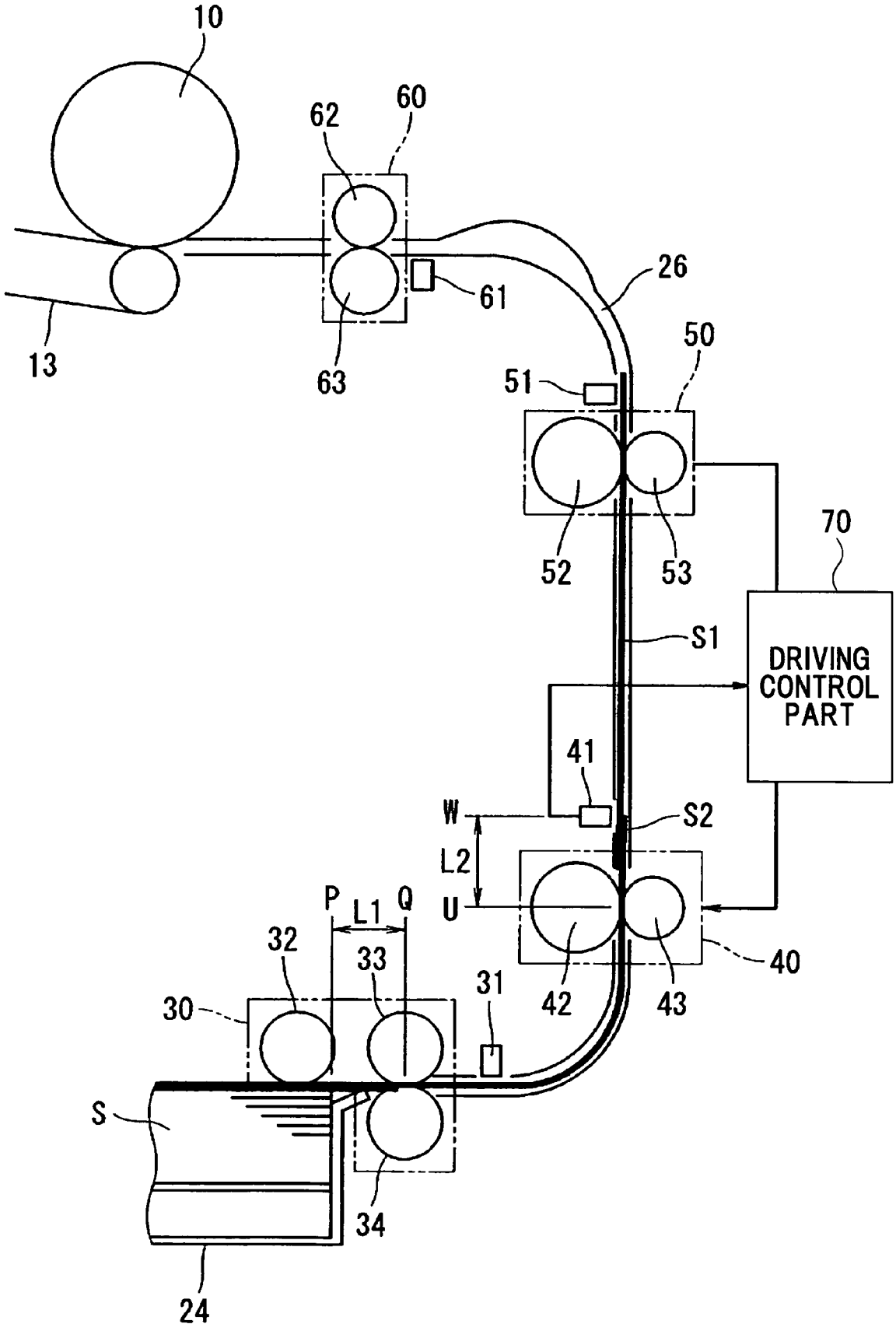
FIG. 14 is a structural view showing another example of the sheet carrier of the present invention.

FIG. 14 is a structural view showing another example of the sheet carrier of the present invention. The sheet carrier shown in FIG. 14 includes the second sheet carriage part 40 and the third sheet carriage part 50. The second sheet carriage part 40 is provided at an upstream side of the sheet carriage path 26. The third sheet carriage part 50 is provided at a downstream side of the sheet carriage path 26. The second sheet carriage part 40 includes the pair of the carriage rollers 42 and 43. The third sheet carriage part 50 includes the carriage rollers 52 and 53. The overlap of the front sheet S1 and the rear sheet S2 carried by the sheet carriage parts 40 and 50 is detected by the second sensor 41 provided between the sheet carriage parts 40 and 50.

The second sheet carriage part 40 and the third sheet carriage part 50 are driving-controlled by the driving control part 70. An output signal of the second sensor 41 is input to the driving control part 70. Furthermore, in this example, the second sensor 41 is provided similar to the first sensor shown in FIG. 5, FIG. 11 or FIG. 12.

The sheet S is carried via the sheet carriage path 26 by driving the second sheet carriage part 40 and the third sheet carriage part 50. When the overlap of the front sheet S1 and the rear sheet S2 is detected by the second sensor 41, the second sheet carriage part 40 is stopped being driving while the third sheet carriage part is kept driving.

Figure 15:
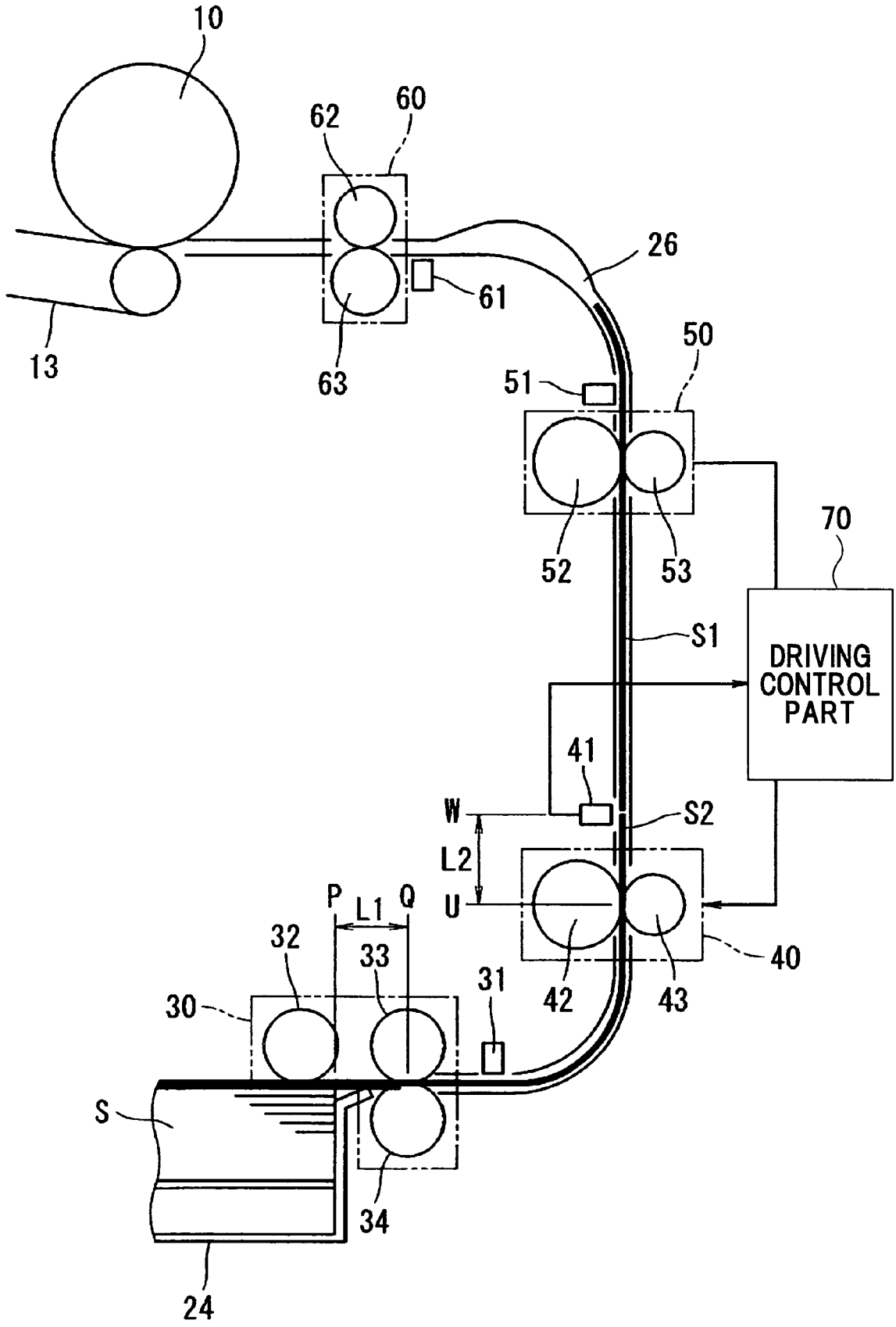
FIG. 15 is a view showing a state where the overlap problem of the sheets is solved.
Figure 16:
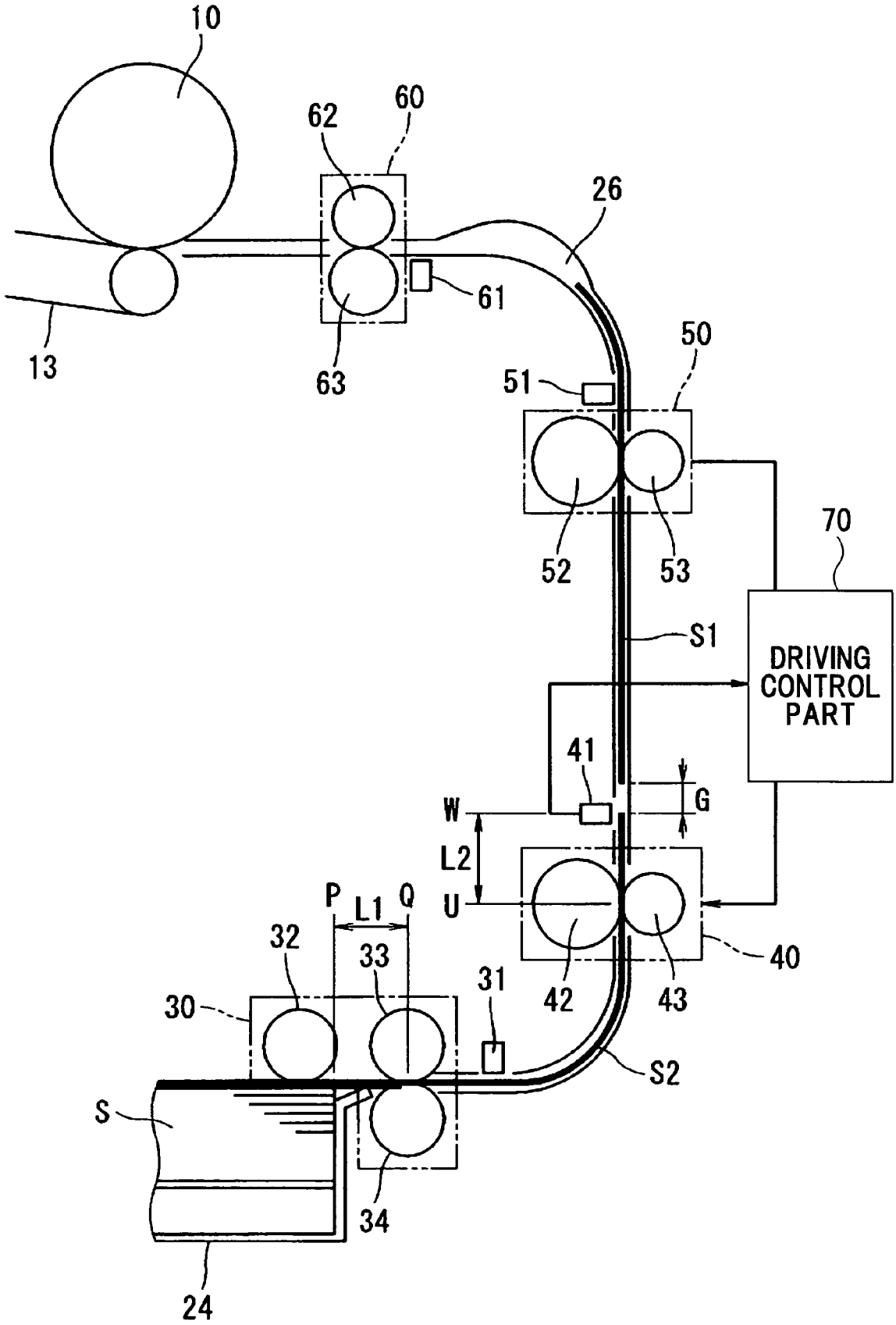
FIG. 16 is a view showing a state where a front sheet and a rear sheet are carried with a designated distance after the overlap problem of the sheets is solved.

As a result of this, only the front sheet S1 is carried while the rear sheet S2 stops, so that the overlap problem is solved as shown in FIG. 15. After the solution of the overlap problem is detected by the second sensor 41 and the designated time is passed, the driving control part 70 restarts driving of the second sheet carriage part 40. In addition, the rear sheet S2 is started being carried again and therefore both sheets S1 and S2 are carried with a designated space G in between as shown in FIG. 16.

It is preferable, as show in FIG. 14, that a distance L2 between the nip position U of the second sheet carriage part 40 (upstream side sheet carriage part) and a detection position W of the second sensor (overlapping detection part) 41 be longer than the distance L1 from the head end position P of the sheet S loaded in the sheet storing cassette 24 (the sheet loading part) to the separation nip position Q of the separation part.

Because of the above-discussed structure, even if the position of the head end of the rear sheet S2 is made non-uniform between the sheet feeding part and the separation part so that the distance between the head end position of the sheets at the sheet loading part and the nip position of the separation part is made L1 as a maximum, as show in FIG. 14, when the overlap of the front sheet S1 and rear sheet S2 is detected by the second sensor 41, the rear end of the front sheet S1 is far from the separation part. Hence, the front sheet S1 is continued to be carried smoothly by the third sheet carriage part 50. Therefore, it is possible to solve the overlap problem of the front sheet S1 and rear sheet S2 reliably.

Figure 17:
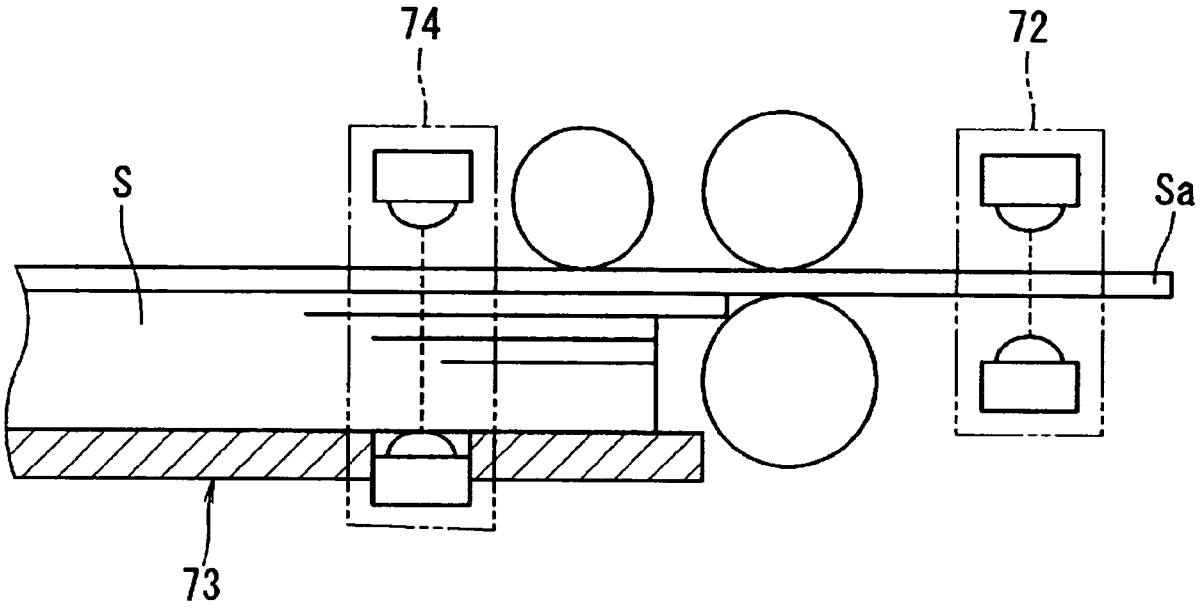
FIG. 17 is a structural view showing other example of the sheet carrier of the present invention.

As shown in FIG. 17, the overlap of the sheets S and an amount of the transmitting light of a single passing sheet Sa are detected by the overlap detection part 72 such as the first sensor 31 and the second sensor 41. Furthermore, a loaded sheet detection part 74 is separately provided so that an amount of the transmitting light of a sheet S loaded in the sheet loaded part 73 is detected. Based on an output signal of the overlap detection part 72 and the loaded sheet detection part 74, the remaining amount of sheets at the sheet loaded part 73 may be detected.

Because of this structure, it is possible to detect the overlap of the sheets and the sheet remaining amount at a low cost under a simple structure.

The present invention is not limited to these embodiments, but variations and modifications may be made without departing from the scope of the present invention.

This patent application is based on Japanese Priority Patent Application No. 2003-117772 filed on Apr. 23, 2003, the entire contents of which are hereby incorporated by reference.

What is claimed is:

1. A sheet carrier, comprising:

an upstream side sheet carriage part provided at an upstream side of a sheet carriage path, the upstream side sheet carriage part including a pair of rollers;

a downstream side sheet carriage part provided at a downstream side of the sheet carriage path;

an overlapping detection part which is provided between the upstream side sheet carriage part and the downstream side sheet carriage part and is configured to detect an overlap of a front sheet and a rear sheet fed by a single supply path upstream of the upstream side sheet carriage part, and carried by the upstream side sheet carriage part and the downstream side sheet carriage part; and a driving control part configured to drive the upstream side sheet carriage part and the downstream side sheet carriage part at the time when the sheets are carried so that the sheets are carried via the sheet carriage path, and configured to stop driving the upstream side sheet carriage part and continue driving the downstream side sheet carriage part at the time when the overlap of the sheets is detected by the overlapping detection part, the driving control part is further configured to stop conveyance of the rear sheet and carry only the front sheet when overlap is detected, wherein the overlapping detection part includes an overlapping sheet detection sensor configured to detect existence of an overlap of the front sheet and the rear sheet, wherein the pair of rollers is a closest pair of upstream rollers provided upstream of the overlapping sheet detection sensor, and wherein a path distance L2 between a nip position of the pair of rollers and a detection position of the overlapping sheet detection sensor is longer than a path distance L1 of a head end position of the sheets at a sheet loading part and the nip position of the pair of rollers.

2. The sheet carrier as claimed in claim 1, wherein the upstream side sheet carriage part includes:

a sheet feeding part configured to feed the sheets from the sheet loading part, and a separation part configured to separate and carry the sheets fed by the sheet feeding part, one by one, the separation part comprising the pair of rollers.

3. The sheet carrier as claimed in claim 2, further comprising:

a loaded sheet detection part configured to detect an amount of transmitted light of the sheets loaded at the sheet loading part;

wherein the overlap of the sheets and an amount of transmitted light of a single sheet passing are detected by the overlapping detection part, and a remaining amount of the sheets at the sheet loading part is detected by receiving an output signal of the loaded sheet detection part and the overlapping detection part.

4. The sheet carrier as claimed in claim 1, wherein the downstream side sheet carriage part is formed by a pair of carriage rollers.

5. The sheet carrier as claimed in claim 1, wherein the overlapping detection part includes:

an emission part; and a light receiving part which is provided at an opposite side to the emission part in a state where the sheet carriage path is put between the emission part and the light receiving part and which is configured to receive light from the emission part.

6. The sheet carrier as claimed in claim 1, wherein the overlapping detection part includes:

an emission part;

a reflection part which is provided at an opposite side to the emission part in a state where the sheet carriage path is put between the emission part and the reflection part and which is configured to reflect light from the emission part; and a light receiving part which is provided at the same side at the sheet carriage path as the emission part and which is configured to receive reflection light from the reflection part.

7. The sheet carrier as claimed in claim 1, wherein the overlapping detection part includes:

an emission part; and a light receiving part which is provided on the same side at the sheet carriage path as the emission part and which is configured to receive light reflected by the sheet passing through the sheet carriage path.

8. The sheet carrier as claimed in claim 1, wherein the overlapping detection part is configured to detect the overlap of the sheets and a sheet passing through the sheet carriage path.

9. The sheet carrier as claimed in claim 8, wherein the driving control part determines that it is difficult to solve the overlap problem of the sheets, if the overlap is detected by the overlapping detection part before a designated time passes after the sheet passing is detected by the overlapping detection part.

10. The sheet carrier as claimed in claim 9, wherein the designated time is set as a time from a detection of a head end of the sheet passing by the overlapping detection part to arrival of the head end at the downstream side sheet carriage part.

11. The sheet carrier as claimed in claim 1, wherein the driving control part restarts driving the upstream side sheet carriage part, after solution of the overlap problem is detected by the overlapping detection part and a designated time passes.

12. A sheet carrier, comprising:

an upstream side sheet carriage part provided at an upstream side of a sheet carriage path, the upstream side sheet carriage part including a pair of rollers;

a downstream side sheet carriage part provided at a downstream side of the sheet carriage path;

overlapping detection means for detecting an overlap of a front sheet and a rear sheet fed by a single supply path upstream of the upstream side sheet carriage part, and carried by the upstream side sheet carriage part and the downstream side sheet carriage part, the overlapping detection means being provided between the upstream side sheet carriage part and the downstream side sheet carriage part; and driving control means for driving the upstream side sheet carriage part and the downstream side sheet carriage part at the time when the sheets are carried so that the sheets are carried via the sheet carriage path, and for stopping driving the upstream side sheet carriage part and continuing driving the downstream side sheet carriage part at the time when the overlap of the sheets is detected by the overlapping detection means, the driving control means is further configured to stop conveyance of the rear sheet and carry only the front sheet when overlap is detected, wherein the overlapping detection means includes an overlapping sheet detection sensor configured to detect existence of an overlap of the front sheet and the rear sheet, wherein the pair of rollers is a closest pair of upstream rollers provided upstream of the overlapping sheet detection sensor, and wherein a path distance L2 between a nip position of the pair of rollers and a detection position of the overlapping sheet detection sensor is longer than a path distance L1 of a head end position of the sheets at a sheet loading part and the nip position of the pair of rollers.

13. The sheet carrier as claimed in claim 12, wherein the upstream side sheet carriage part includes:

a sheet feeding part configured to feed the sheets from the sheet loading part, and a separation part configured to separate and carry the sheets fed by the sheet feeding part, one by one, the separation part comprising the pair of rollers.

14. The sheet carrier as claimed in claim 13, further comprising:

loaded sheet detection means for detecting an amount of transmitted light of the sheets loaded at the sheet loading part;

wherein the overlap of the sheets and an amount of transmitted light of a single sheet passing are detected by the overlapping detection means, and a remaining amount of the sheets at the sheet loading part is detected by receiving an output signal of the loaded sheet detection means and the overlapping detection means.

15. The sheet carrier as claimed in claim 12, wherein the driving control means restarts driving the upstream side sheet carriage part, after solution of the overlap problem is detected by the overlapping detection means and a designated time passes.

16. An image forming device having a sheet carrier, the sheet carrier comprising:

an upstream side sheet carriage part provided at an upstream side of a sheet carriage path, the upstream side sheet carriage part including a pair of rollers;

a downstream side sheet carriage part provided at a downstream side of the sheet carriage path;

an overlapping detection part which is provided between the upstream side sheet carriage part and the downstream side sheet carriage part and is configured to detect an overlap of a front sheet and a rear sheet fed by a single supply path upstream of the upstream side sheet carriage part, and carried by the upstream side sheet carriage part and the downstream side sheet carriage part; and a driving control part configured to drive the upstream side sheet carriage part and the downstream side sheet carriage part at the time when the sheets are carried so that the sheets are carried via the sheet carriage path, and configured to stop driving the upstream side sheet carriage part and continue driving the downstream side sheet carriage part at the time when the overlap of the sheets is detected by the overlapping detection part, the driving control part is further configured to stop conveyance of the rear sheet and carry only the front sheet when overlap is detected, wherein the overlapping detection part includes an overlapping sheet detection sensor configured to detect existence of an overlap of the front sheet and the rear sheet, wherein the pair of rollers is a closest pair of upstream rollers provided upstream of the overlapping sheet detection sensor, and wherein a path distance L2 between a nip position of the pair of rollers and a detection position of the overlapping sheet detection sensor is longer than a path distance L1 of a head end position of the sheets at a sheet loading part and the nip position of the pair of rollers.

17. The image forming device as claimed in claim 16, wherein the upstream side sheet carriage part includes:

a sheet feeding part configured to feed the sheets from the sheet loading part, and a separation part configured to separate and carry the sheets fed by the sheet feeding part, one by one, the separation part comprising the pair of rollers.

18. The image forming device as claimed in claim 17, further comprising:

a loaded sheet detection part configured to detect an amount of transmitted light of the sheets loaded at the sheet loading part;

wherein the overlap of the sheets and an amount of transmitted light of a single sheet passing are detected by the overlapping detection part, and a remaining amount of the sheets at the sheet loading part is detected by receiving an output signal of the loaded sheet detection part and the overlapping detection part.

19. The image forming device as claimed in claim 16, wherein the driving control part restarts driving the upstream side sheet carriage part, after solution of the overlap problem is detected by the overlapping detection part and a designated time passes.

* * * * *